United States Patent [19]

Fester et al.

[11] 4,383,086

[45] May 10, 1983

[54] FILAMENTS AND FIBERS OF ACRYLONITRILE COPOLYMER MIXTURES

[75] Inventors: Walter Fester, Königstein; Bernd Huber, Hofheim am Taunus; Gerhard Schmidt, Bad Soden am Taunus, all of Fed. Rep. of Germany

[73] Assignee: Hoechst Aktiengesellschaft, Frankfurt am Main, Fed. Rep. of Germany

[21] Appl. No.: 154,488

[22] Filed: May 29, 1980

[30] Foreign Application Priority Data

Jun. 2, 1979 [DE] Fed. Rep. of Germany ..... 2922667

[51] Int. Cl.[3] ..... C08L 33/20

[52] U.S. Cl. ..... 525/238; 264/182; 264/206; 264/210.7; 525/931

[58] Field of Search ..... 264/182, 206, 210.7; 525/201, 203, 198, 931, 238

[56] References Cited

U.S. PATENT DOCUMENTS

| | | | |
|---|---|---|---|
| 3,404,204 | 10/1968 | Nakagawa et al. | 264/182 |
| 3,814,739 | 6/1974 | Takeda | 264/182 |
| 3,846,226 | 11/1974 | Smithey | 264/182 |
| 3,963,790 | 6/1976 | Couchoud | 264/182 |
| 4,036,803 | 7/1977 | Kobashi et al. | 525/238 |
| 4,081,498 | 3/1978 | Mavanci | 264/182 |
| 4,223,108 | 9/1980 | Cazzavo et al. | 264/182 |
| 4,226,824 | 10/1980 | Cazzavo et al. | 264/182 |
| 4,256,684 | 3/1981 | Achard et al. | 264/182 |
| 4,287,148 | 9/1981 | Cazzavo et al. | 264/182 |

FOREIGN PATENT DOCUMENTS

| | | |
|---|---|---|
| 1509804 | 1/1968 | France . |
| 2228869 | 6/1974 | France . |
| 1059385 | 2/1967 | United Kingdom . |

*Primary Examiner*—Jay H. Woo

*Attorney, Agent, or Firm*—Curtis, Morris & Safford

[57] ABSTRACT

The invention relates to flame-retarding filaments and fibers and a process for the manufacture thereof. The filament-forming substance is a mixture of from 20 to 70 weight % of an acrylonitrile copolymer A containing at least 80 weight % of acrylonitrile units and from 0.3 to 20 weight % of other units copolymerizable with acrylonitrile, and from 80 to 30 weight % of an acrylonitrile copolymer B containing from 50 to 75 weight % of acrylonitrile units, from 25 to 45 weight % of vinyl chloride and/or vinylidene chloride units and from 0 to 5 weight % of other units copolymerizable with acrylonitrile.

The filaments and fibers have a boil-off shrinkage of at least 20% and a knot strength of at least 10 cN/tex and are obtained by spinning the turbid solutions of the copolymer mixture, which however do not separate into components, in an aprotic solvent, and drawing of the filaments in a moderate ratio.

3 Claims, No Drawings

FILAMENTS AND FIBERS OF ACRYLONITRILE COPOLYMER MIXTURES

The invention provides flame-retarding acrylic filaments and fibers which in addition to high shrinkage are distinguished especially by low brittleness, and a process for the manufacture thereof. The filament-forming substance of these filaments and fibers is a mixture of different acrylonitrile copolymers which, although they do not form a homogeneous solution in aprotic solvents used for spinning, these solutions do not separate into components, either.

Manufacture of acrylic fibers having high shrinkage values is state of the art. A corresponding process is for example described in German Offenlegungsschrift No. 25,32,120, according to which such high-shrinkage filaments are obtained by saturated steam-setting of the filament spun but not yet drawn, and subsequent drawing by the factor of 1:3.5 to 1:5.0. However, high shrinkage fibers so obtained are very brittle, which causes considerable trouble on processing of the fibers and thus reduced performance characteristics. Moreover, these acrylic fibers have no flame-retarding properties.

It is furthermore known that the shrinkage values of acrylonitrile copolymer filaments rise with increasing content of vinyl chloride or vinylidene chloride components. Since such comonomer components can impart flame-retarding properties to the filaments and fibers, attempts have been made to improve the performance characteristics of fibers made from such copolymers.

For example, fibers are known which consist of a polymer containing 60% of acrylonitrile and 40% of vinyl chloride, which have a shrinkage of more than 30% and a good knot strength. The decisive disadvantages of these fibers on the basis of such copolymers are the insufficient heat resistance thereof and the considerable dependence of their shrinkage values on the temperature of treatment. When these filaments are shrunk for example by treatment in boiling water, a subsequent heat treatment causes further heavy shrinkage even at moderately elevated temperatures, and at a temperature around 150° C. the shrinkage has generally attained a degree where the fiber structure cannot be identified any more. Of course, such filaments or fibers cannot be used any more for the manufacture of carpets, for example, because they do not resist to the temperatures required for the coating of the back.

The textile-technological performance characteristics of such fibers of acrylonitrile/vinyl chloride or acrylonitrile/vinylidene chloride copolymers can be improved by using mixtures of different acrylonitrile copolymers, where one of the components consists substantially of polyacrylonitrile and the other of polyvinyl chloride or polyvinylidene chloride. Use of such mixture allows to reduce the disadvantages of filaments of acrylonitrile/vinyl halide copolymers, that is, bonding temperatures of below 150° C., insufficient thermostability, sensitivity of usual solvents. Simultaneously, when using such mixtures of different copolymers for the manufacture of acrylic fibers, a considerably reduced tendency to shrinkage of these fibers is observed.

However, when preparing spinning solutions of different acrylonitrile copolymers, a further problem arises which is defined as incompatibility of the copolymers. For example, when the diverse copolymers are dissolved individually in dimethyl formamide, and the two copolymer spinning solutions are intermixed subsequently, turbidity or even separation into the components occurs. For a long time the general opinion was that this incompatability of the copolymers in the spinning solution would initably have a noxious influence on the quality of fibers and filaments manufactured from this solution. A large number of proposals to overcome this incompatibility have therefore been made in the literature, for example by addition of solubilizing copolymers (German Auslegeschrift No. 12,79,889), use of graft polymers (U.S. Pat. No. 27,63,631), choice of defined mixing ranges of selected copolymer compositions, or of special polymerization conditions (German Auslegeschrift No. 15,69,153).

The properties of filaments and fibers so obtained may come near to those of polyacrylonitrile filaments when the copolymers and the mixing ratio are suitably chosen. For example, such filaments may have again elevated softening temperatures and reduced sensitivity to solvents, but on the other hand their shrinkage values are low.

Of recent years, however, it has been realized that acrylonitriles incompatible with each other can be spun from solutions. German Offenlegungsschrift No. 23,40,463 describes for example non-flammable fibers consisting of two acrylonitrile/vinylidene chloride copolymers, which, however, have low shrinkage values. This is valid, too, for filaments which according to German Offenlegungsschrift No. 16,69,566 consist of a filament-forming polymer mixture containing preferably more than 90% of polyacrylonitrile and less than 10% of polyvinyl chloride or a corresponding copolymer. Also in this case, filaments and fibers are obtained the shrinkage values of which are low.

It was therefore still the object of this invention to provide flame-retarding filaments and fibers of acrylonitrile copolymers which are distinguished by high shrinkage at low brittleness, which do not continue to shrink substantially in a temperature rage above the shrinkage-producing temperature, for example a range of from 140° to 190° C., and which are suitable for the manufacture of flame-retarding articles.

In accordance with the invention, there has been surprisingly found that filaments and fibers having the intended broad range of properties are attained by spinning together from one solution at least two arylonitrile copolymers of different composition, one of which at least contains halogen; the polymers being incompatible with one another in the solvents used. The filament-forming substance of these filaments and fibers consists of a mixture of from 20 to 70 weight % of an acrylonitrile copolymer A containing at least 80 weight % of acrylonitrile units and from 0.3 to 20 weight % of other units copolymerizable with acrylonitrile, and from 80 to 30 weight % of an acrylonitrile copolymer B containing from 50 to 75 weight % of acrylonitrile units, from 25 to 45 weight % of vinyl chloride and/or vinylidene chloride units and from 0 to 5 weight % of other units copolymerizable with acrylonitrile. The filaments and fibers of the invention are distinguished by a boil-off shrinkage of 20% and more, and a knot strength of more than 10 cN/tex. The filament-forming substance is not homogeneously soluble as a 24% solution in N,N-dimethyl formamide.

Preferred are filaments and fibers where the mixture of copolymers A and B is in a weight range of from 40:60 to 60:40.

Preferably, the filaments and fibers of the invention have a boil-off shrinkage of more than 30% and knot strength of more than 12 or even more than 15 cN/tex. An especially favorable property of the filaments and fibers of the invention resides in the fact that the shrinkage value depends on the shrinkage temperature to a small extent only. When, for example, shrinkage of the filaments and fibers according to the invention is produced by saturated steam at 110° C. and the filaments are subjected to temperatures of, for example, 120° or 140° C. in a subsequent processing step, the additional shrinkage due to the temperature which is superior to that producing the shrinkage is rather insignificant. In contrast thereto, the shrinkage values of fibers of a homogeneous copolymer having a comparable halogen content increase considerably on such temperature rise, so that complete destruction of the fiber structure may be the result in certain cases.

The acrylonitrile copolymers A and B should consist of acrylonitrile units and, in the case of the copolymer B, of vinyl chloride and/or vinylidene chloride units in addition, and contain further units copolymerizable with acrylonitrile.

Suitable comonomers of acrylonitrile are for example acrylic, alpha-chloroacrylic or methacrylic acid or the esters or amides thereof, such as methylmethacrylate, acrylic acid methyl ester, acrylamide, methacrylonitrile; vinyl ketones such as methylvinylketone; vinyl carboxylates such as vinyl acetate; other compounds containing the vinyl group such as vinylsulfonic acid, allyl- or methallylsulfonic acid; ethylene-alpha, beta-dicarboxylic acids and the anhydrides or derivatives thereof; styrenes; vinyl-substituted tertiary heterocyclic amines such as vinyl pyridines or vinyl imidazoles; or vinyl halogen compounds such as vinyl chloride, vinylidene chloride, vinyl bromide etc.

In accordance with the invention, vinyl chloride and vinylidene chloride are excluded in the case of the other monomers copolymerizable with acrylonitrile used for preparing the copolymer B.

By "not homogeneously soluble", there is to be understood incompatibility of the copolymers used in the mixture, which incompatibility is recognized with an unaided eye already by the turbidity of the corresponding solutions. Quantitative evidence on the degree of incompatibility of diverse copolymers is obtained by spectrophotometric methods only. A suitable determination method is the following: a 24% solution of the copolymer mixture or the fibers manufactured therefrom in N,N-dimethyl formamide is prepared, which solution is measured in a 1 cm glass cuvette by means of the spectrophotometer DB-GT of Messrs. Beckman against air; the absorption (measuring range 0 to 2 A) being determined at 850 nm. Data obtained according to this measuring method are indicated in the Examples. Under these measuring conditions, incompatibility or inhomogeneous solution is present in each case where an absorption of more than 0.20 is stated.

The spinning process required for the manufacture of the filaments and fibers of the invention differs considerably from the hitherto known processes for the manufacture of high-shrinkage fibers of acrylonitrile or the corresponding copolymers. For, it has been found that the high-shrinkage filaments of the invention require no steam-setting as described for example in German Offenlegungsschrift No. 25,32,120 before or after the drying. Thus, the manufacturing process is considerably simplified.

This novel process for obtaining high-shrinkage filaments and fibers consists substantially of the following operational steps: Two copolymers of acrylonitrile A and B incompatible in solution are mixed in the intended ratio, and in a vessel provided with agitator this mixture is dissolved in an aprotic solvent, preferably dimethyl formamide or dimethyl acetamide, to form a spinning solution of usual concentration. Such spinning solutions have generally a concentration of above 20 weight %; in the Examples, a 24% solution was used in each case. Alternatively, the spinning solution may be prepared from the mixture of the copolymers in the following manner: the individual copolymers are first dissolved separately, and these solutions are then blended by means of a dynamic or static mixer to form the intended composition.

After the usual degassing and safety filtration, a solution prepared in the above manner is forced through spinnerets by means of a spinning pump. It is advantageous to heat the spinning solution to an elevated temperature prior to spinning. Depending on the spinning process chosen, filament formation occurs by diffusion of part of the solvent molecules either in the gas environment (in the case of dry spinning) or in the aqueous coagulation bath which in addition to water contains usually a considerable percentage of the solvent used.

After solidification in the spinning bath (or in the heater channel in dry spinning), the freshly spun filaments containing generally a considerable amount of the polymer solvent are subjected to a wet drawing. The drawing bath containing preferably a large amount of solvent in addition to water should have a temperature of from 40° to 90° C. The filaments are drawn therein in a ratio of from 1:1 to 1:2.5, preferably 1:1.2 to 1:1.7, and subsequently, as usual, washed and treated with surfactants, that is, finished. It is advantageous to allow shrinkage of the filaments to a small extent, preferably up to 15%, during this washing and finishing. Subsequently, the filaments are dried at temperatures of preferably below 150° C. without allowing further shrinkage, and then after-drawn in a ratio of from 1:1.2 to 1:4, preferably 1:1.5 to 1:2.3 by means of a heater. The total drawing ratio, that is, of wet drawing and after-drawing, should be from 1:1.5 to 1:4, preferably 1:2 to 1:3.

After-drawing is carried out without applying steam to the dried filaments. Especially suitable is the use of contact heater zones; and the heater temperatures should be from 120° to 180° C., preferably 130° to 150° C.

The filaments and fibers so treated my then be further processed, for example crimped mechanically, cut into staple fibers, etc.

Due to their halogen content, the filaments or fibers obtained are flame-retarding. They are distinguished by high shrinkage, very low brittleness degree and a good thermostability. Blended with fibers of normal shrinkage, fibers of the invention give yarns having especially high bulk. The flame-proofing effect of the high-shrinkage fibers of the invention is maintained in fiber mixtures especially in the case where the non-shrinking fibers of such a blend are correspondingly flame-retarding, too.

The following examples illustrate the invention; amounts and percentages being by weight unless otherwise stated.

EXAMPLES 1 TO 14

In these Examples, the following copolymers were used:

TABLE 1

| Copolymer | Polymer composition |
|---|---|
| a | 94.3% acrylonitrile,<br>6% acrylic acid methyl ester,<br>0,7% Na—methallyl sulfonate, |
| b | 57% acrylonitrile<br>40% vinylidene chloride,<br>3% Na—methallyl sulfonate, |
| c | 80% acrylonitrile,<br>15% vinylidene chloride,<br>3% acrylic acid methyl ester,<br>2% sodium methallyl sulfonate, |
| d | 67% acrylonitrile,<br>30% vinylidene chloride,<br>3% Na—methallyl sulfonate, |
| e | 72% acrylonitrile,<br>25% vinylidene chloride,<br>3% Na—methallyl sulfonate. |

These copolymers were dissolved individually and as mixtures in N,N-dimethyl formamide or N,N-dimethyl acetamide to form 24% solutions. Each solution so obtained was heated to 60° C., and spun with the aid of a spinning pump through a spinneret having 300 holes of a hole diameter of 80 μm into a coagulation bath containing 49% of water and 51% of dimethyl formamide, and having a temperature of 69° C. The tow so obtained was withdrawn from the spinneret at a speed of 13 m/min, and drawn in a drawing bath in a ratio of 1:1.45. The drawing bath consisted of 64% of dimethyl formamide and 36% of water, the temperature was 80° C. The tow so drawn was subsequently washed and finished in further baths according to known methods, while allowing a total shrinkage of 10% in these process steps. Subsequently, the tow was dried at 135° C. in a drum dryer without allowing any further shrinkage.

After-drawing was then carried out in a ratio of 1:1.8 by contacting the tow with a heater having a surface temperature of 135° C. Subsequently, the monofilaments of the tow were crimped in a stuffer box in known manner and then cut into staple fibers.

The alterations of data of the individual Examples, the measuring values of spinning solutions and filaments manufactured are listed in the following Table 2. As this Table shows, the spinning conditions chosen allow manufacture of filaments having a high shrinkage at the boil even from pure copolymers. However, the knot strength of such filaments is very low. When using mixtures of copolymers incompatible in solution (absorption of the spinning solution greater than 0.2) knot strength values were obtained which are superior to 10 cN/tex, often even superior to 12 cN/tex. In the case of a mixing ratio of 40:60 to 60:40, a knot strength of 15 cN/tex and more can be obtained.

TABLE 2

| Example No. | Copolymers used | Mixing ratio | Absorption of spinning solution | Titer dtex | Tensile stress cN/tex | Elongation % | Knot strength cN/tex | Boil-off shrinkage |
|---|---|---|---|---|---|---|---|---|
| 1 (comp.) | a | 100 | 0.06 | 10 | 16 | 20 | 8 | 39 |
| 2 (comp.) | b | 100 | 0.12 | 9 | 14 | 17 | 9 | 40 |
| 3 (comp.) | c | 100 | 0.10 | 10 | 13 | 17 | <5 | 37 |
| 4 | a/b | 70:30 | >0.2 | 9 | 16 | 20 | 12 | 39 |
| 5 | a/b | 60:40 | >0.2 | 9 | 16 | 25 | 14 | 41 |
| 6 | a/b | 50:50 | >0.2 | 9 | 17 | 30 | 17 | 41 |
| 7 | a/b | 40:60 | >0.2 | 9 | 16 | 30 | 16 | 41 |
| 8 | a/b | 30:70 | >0.2 | 9 | 17 | 35 | 15 | 41 |
| 9 | a/b | 20:80 | >0.2 | 14 | 16 | 32 | 15 | 41 |
| 10 (comp.) | a/c | 50:50 | 0.10 | 10 | 15 | 11 | <5 | 35 |
| 11 | b/c | 50:50 | >0.2 | 10 | 12 | 12 | 12 | 35 |
| 12 | a/d | 50:50 | >0.2 | 15 | 18 | 22 | 17 | 37 |
| 13 | a/e | 50:50 | >0.2 | 17 | 19 | 41 | 18 | 39 |
| 14 | a/b | 50:50 | >0.2 | 9 | 15 | 30 | 14 | 39 |

In Example 14, N,N—dimethyl-acetic amide was used as solvent instead of N,N—dimethyl-formamide

EXAMPLE 15

Fibers of Example 6 were spun to form a yarn and processed to a woven carpet having a pile weight of 850 g/m². This carpet was tested for flammability according to German Industrial Standard DIN 54332. The values obtained are listed in the following Table 3.

TABLE 3

| Exposure time sec | mark 250 mm | area damaged mm × mm | combustion time sec |
|---|---|---|---|
| 5 | not attained | 70 × 20 | 0 |
| 15 | " | 110 × 30 | 0 |
| 30 | " | 145 × 30 | 0 |
| 60 | " | 162 × 30 | 0 |

A carpet manufactured from this material corresponds to the requirements of the above Standard, it is flame-retarding.

EXAMPLES 16 TO 30

According to Examples 1 to 14, a 24% spinning solution in dimethyl formamide was prepared with the use of copolymers A and B in a ratio of 1:1, and the solutions were forced through a spinneret having 300 holes of a hole diameter of 80 μm into a coagulation bath containing 51% of dimethyl formamide and 49% of water, and having a temperature of 70° C. The filaments were drawn off from the coagulation bath at a speed of 13.5 m/min, and drawn in a drawing bath containing 64% of dimethyl formamide and 36% of water. Subsequently, they were washed in water while allowing partial shrinkage, finished, dried on godets, and drawn on a contact heater. Wet drawing, temperature of drawing and washing baths, wet shrinkage, after-drawing and total drawing ratio were altered in each case. The data are listed in the Table 4, which Table indicates also the values of shrinkage at the boil of the filaments so obtained, and selected knot strength data of these filaments.

The results of Examples 16 to 30 prove that there is an optimal range for the values of wet drawing and of after-drawing, and that especially the temperature of the heater used for after-drawing has a considerable influence on the shrinkage at the boil and, possibly, on the knot strength, too.

TABLE 4

| Example No. | Ratio of wet drawing | Drawing and washing temperature °C. | Wet shrinkage | After-drawing draw ratio | After-drawing temperature °C. | Ratio of total drawing | boil-off shrinkage % | Knot strength cN/tex |
|---|---|---|---|---|---|---|---|---|
| 16 | 1:1 | 80–90 | 0 | 1:2.44 | 150 | 1:2.44 | 36 | |
| 17 | 1:1 | 50 | 0 | 1:2.44 | 135 | 1:2.44 | 37 | 14 |
| 18 | 1:1.13 | 80–90 | 4.6 | 1:2.28 | 150 | 1:2.44 | 38 | |
| 19 | 1:1.42 | 80–90 | 9.4 | 1:1.90 | 150 | 1:2.44 | 40 | 17 |
| 20 | 1:1.87 | 80–90 | 7.9 | 1:1.42 | 150 | 1:2.44 | 31 | |
| 21 | 1:1.87 | 50 | 7.9 | 1:1.42 | 135 | 1:2.44 | 28 | |
| 22 | 1:2.44 | 80–90 | 9.1 | 1:1.10 | 150 | 1:2.44 | 12 | |
| 23 | 1:1.42 | 80–90 | 9.4 | 1:1.44 | 150 | 1:1.85 | 32 | |
| 24 | 1:1.42 | 80–90 | 9.4 | 1:1.67 | 150 | 1:2.15 | 39 | 16 |
| 25 | 1:1.42 | 80–90 | 9.4 | 1:2.13 | 150 | 1:2.74 | 39 | 18 |
| 26 | 1:1.42 | 50 | 9.4 | 1:2.13 | 135 | 1:2.74 | 36 | |
| 27 | 1:1.42 | 80–90 | 9.4 | 1:2.59 | 150 | 1:3.33 | 34 | |
| 28 | 1:1.42 | 80–90 | 9.4 | 1:1.90 | 135 | 1:2.44 | 42 | 17 |
| 29 | 1:1.42 | 80–90 | 9.4 | 1:1.90 | 150 | 1:2.44 | 42 | 16 |
| 30 | 1:1.42 | 80–90 | 9.4 | 1:1.90 | 180 | 1:2.44 | 33 | 15 |

What is claimed is:

1. A filament or fiber of mixtures of two acrylonitrile copolymers, wherein the filament-forming substance consists of a mixture of from 20 to 70 weight % of an acrylonitrile copolymer A containing at least 80 weight % of acrylonitrile units and from 0.3 to 20 weight % of other units copolymerizable with acrylonitrile, and from 80 to 30 weight % of an acrylonitrile copolymer B containing from 50 to 75 weight % of acrylonitrile units, from 25 to 45 weight % of vinyl chloride and/or vinylidene chloride units and from 0 to 5 weight % of other units copolymerizable with acrylonitrile; the filaments having a boil-off shrinkage of 20% and more and a knot strength of more than 10 cN/tex, and the filament-forming substance of A and B not being homogeneously soluble as a 24% solution in N,N-dimethyl formamide.

2. The filaments and fibers as claimed in claim 1, wherein the filament-forming substance is a mixture of copolymers A and B in a weight ratio of from 40:60 to 60:40.

3. The filaments and fibers as claimed in claims 1 or 2 having a boil-off shrinkage of more than 30% and a knot strength of more than 12 cN/tex.

* * * * *